United States Patent [19]

Wylie

[11] Patent Number: 4,993,629

[45] Date of Patent: Feb. 19, 1991

[54] SYSTEM FOR MODIFYING TEMPERATURES OF MULTI-STORY BUILDING INTERIORS

[75] Inventor: Calvin R. Wylie, Fair Oaks, Calif.

[73] Assignee: Beutler Heating and Air Conditioning, Inc., Sacramento, Calif.

[21] Appl. No.: 487,790

[22] Filed: Mar. 5, 1990

Related U.S. Application Data

[63] Continuation-in-part of Ser. No. 345,728, May 1, 1989, Pat. No. 4,915,294.

[51] Int. Cl.[5] ..... F24F 7/00

[52] U.S. Cl. ..... 236/11; 98/34.6; 236/49.3

[58] Field of Search ..... 236/49.3, 10, 78 B, 236/11; 48/34.6

[56] References Cited

U.S. PATENT DOCUMENTS

| | | | |
|---|---|---|---|
| 2,235,620 | 3/1941 | Nessell | 236/11 X |
| 4,184,415 | 1/1980 | Nicholson | 98/31.5 |
| 4,507,929 | 4/1985 | Dozier | 236/49.3 X |

*Primary Examiner*—William E. Wayner

*Attorney, Agent, or Firm*—Thomas R. Lampe

[57] ABSTRACT

Apparatus for modifying the temperatures of upper and lower level building interiors including air delivery means, heat generating means and first and second temperature sensing means for sensing the temperatures of the upper and lower level interiors. Air is delivered from the upper level interior to the lower level interior when there is a first sensed temperature differential between the interiors and the air is heated when the sensed differential drops to a predetermined lesser magnitude.

11 Claims, 2 Drawing Sheets

SYSTEM FOR MODIFYING TEMPERATURES OF MULTI-STORY BUILDING INTERIORS

This application is a continuation-in-part of my U.S. application Ser. No. 07/345,728, filed May 1, 1989, now U.S. Pat. No. 4,915,294.

TECHNICAL FIELD

This invention relates to an apparatus and method for modifying the temperatures of interiors of a multi-story building. In particular, the arrangement disclosed herein provides independent control at the floors of a multi-story building structure, automatically monitors and rectifies the heat stratification which normally occurs between floors of a multi-story building, and controls operation of the heating source for the building in an efficient manner.

BACKGROUND ART

Prior art systems exist which control heating and cooling of supply air to a plurality of floors or other building zones independently based on the set point of a thermostat in each zone. Conventionally, such arrangements operate by opening the damper in each zone if that zone calls for the hot or cold air which is available from a central heating/cooling system. These prior art systems are not energy efficient since they actuate the furnace or other heat source to heat the downstairs zone when the upstairs is already over heated.

It is also known in the art of building structure heating to propel air, as by means of a fan, from a lower level to an upper level. Often systems of this nature are deficient in that they require either continuous fan operation, which itself utilizes excess amounts of energy, or constant manual intervention, which is both inefficient and time consuming.

The invention disclosed in my above-identified patent application relates to a system which operates automatically to lessen the differential of temperatures in upper and lower building level interiors. The system operates by redistributing the hot air which normally rises to the upper levels of a multi-story building to a lower level, thereby providing a more uniform temperature throughout the building.

DISCLOSURE OF THE INVENTION

The system of the present invention is, in essence, an improvement of the system disclosed in my prior application. In common therewith, the present arrangement incorporates structure which is operable to automatically initiate an air flow from an upper level interior to a lower level interior when sensed temperatures at said interiors differ to a predetermined extent. However, the present arrangement differs from my earlier invention in that it incorporates heat generating means and controls the operation of the heat generating means to heat the air delivered to the lower level interior after the temperature differential between the upper level and lower level interiors has reached a predetermined level below the temperature differential required to initiate air flow between the upper and lower level interiors. In other words, with the present system, the burner of a furnace or other heat generating means is not actuated until efficient use is made of the heated air in an upper level interior to heat the lower level interior.

The apparatus of the present invention includes air delivery means. The apparatus additionally includes heat generating means such as a furnace gas burner.

First duct means providing air flow communication between the air delivery means and upper and lower levels of a building. Second duct means provides air flow communication between the upper level interior and the air delivery means.

First temperature sensing means is employed for sensing the temperature of the lower level interior and second temperature sensing means is employed to sense the temperature of the upper level interior.

Control means is operatively associated with the air delivery means and the heat generating means for actuating the air delivery means to deliver air from the upper level interior to the lower level interior through the first and second duct means when a temperature differential of a first predetermined magnitude is sensed by the first and second sensing means.

The control means actuates the heat generating means to heat the air delivered by the air delivery means to the lower level interior when a temperature differential of a second predetermined magnitude (which is less than the first predetermined magnitude) is sensed by the first and second sensing means.

Other features, advantages and objects of the present invention will become apparent with reference to the following detailed description and accompanying drawings.

DISCLOSURE OF THE INVENTION

Figure 1:
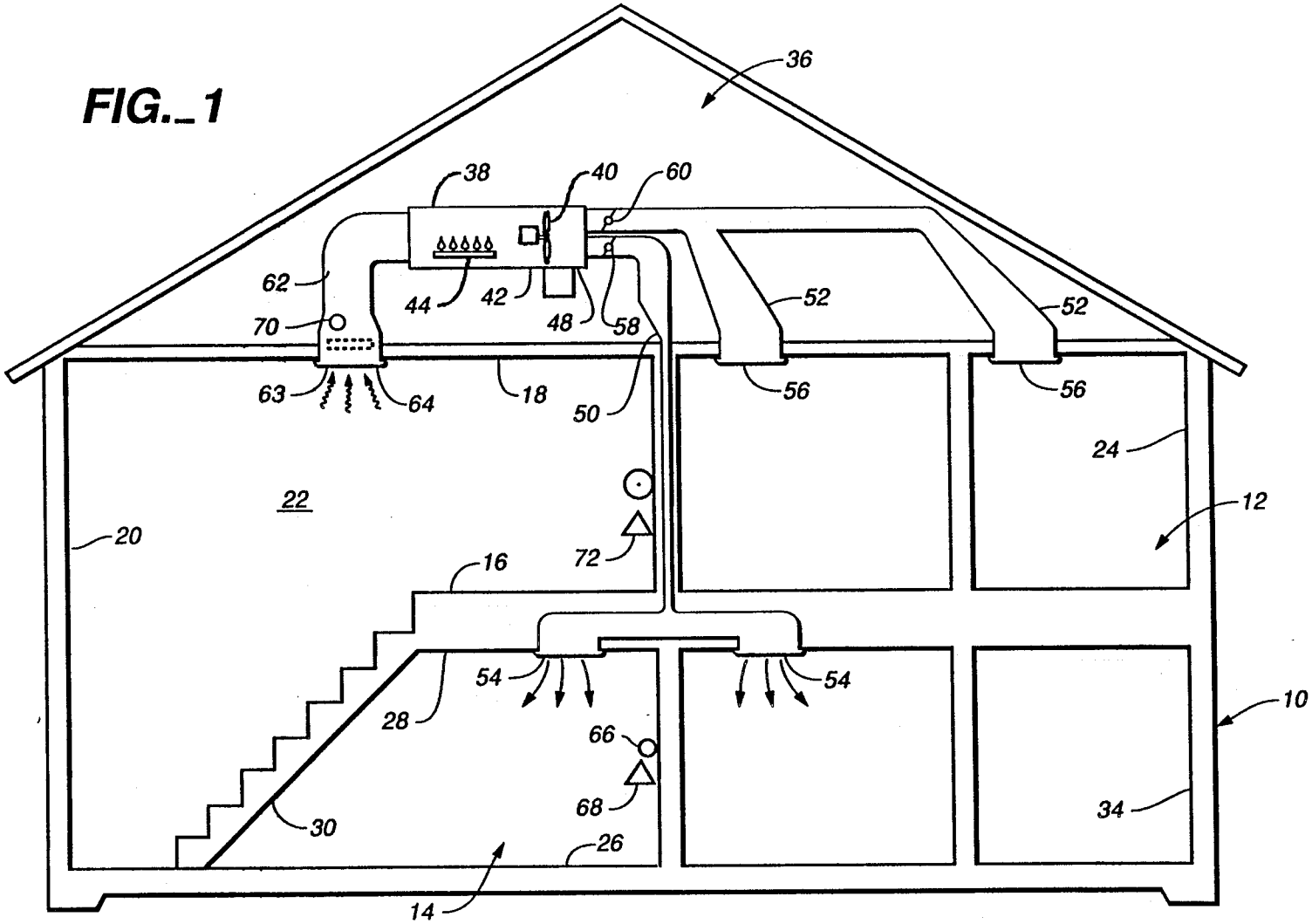
FIG. 1 is a diagrammatic side view of the inside of a multi-level building incorporating apparatus constructed in accordance with the teachings of the present invention.

Referring now to the drawings, a multi-story or multi-level building 10, which may be of any suitable construction, is illustrated. Building 10 includes an upper level 12 and a lower level 14. Upper level 12 includes, as is conventional, a floor 16, a ceiling 18, and walls, such as walls 20, 22 and 24, between the floor and ceiling to define a interior.

Similarly, lower level 14 includes a floor 26, a ceiling 28, and walls, such as walls 30, 32 and 34 which define a lower level interior.

The illustrated building also includes an attic 36 above ceiling 18. Positioned in the attic is a furnace 38. Furnace 38 includes air delivery means in the form of a fan 40 and a motor 42 of any suitable conventional type adapted to rotate the fan 40 when energized.

The furnace additionally includes heat generating means which in the furnace embodiment illustrated is a gas jet assembly 44 selectively communicable with a suitable source of gas (not shown). It is to be understood, however, that the heat generating means may be electrical coils or any other suitable conventional heat generation apparatus.

A plenum 48 is located at the end of furnace 38. Leading from plenum 48 is first duct means including two discrete ducts 50 and 52. Duct 50 has an outlet 54 in communication with the interior of lower level 14. Duct 52 has an outlet 56 in communication with the interior of upper level 12.

A damper 58 is disposed in duct 50 and a damper 60 is disposed in duct 52. The dampers may be of any suitable type including round motorized dampers well known in the building heating art. The ducts 50, 52 must be sized to handle additional air volume when either damper has been closed. For optimum operation of the system and user comfort, it is recommended that the duct system serving each level be sized to handle 75 per cent of the total system air flow or the design air flow for that level's interior, whichever is greater.

Second duct means in the form of duct 62 provides air flow communication between the interior of upper level 12 and the air delivery means including fan 40 and motor 42. Duct 62 has an inlet 64 located at ceiling 18 of upper level 12. Optionally, an air filter 63 may be disposed in duct 62.

First temperature sensing means is provided for sensing the temperature of the interior of lower level 14. The first temperature sensing means is in the form of a temperature sensor or probe 66 which, as shown, may be adjacent to a thermostat 68. Alternatively, of course, the sensor could be located in the thermostat.

Second temperature sensing means in the form of a temperature sensor or probe is provided for sensing the temperature of the interior of the upper level 12. This sensor is identified by reference numeral 70 and, as illustrated in the drawings, a preferred location for such temperature sensor is at the return air inlet 64.

A thermostat is also located in the interior of upper level 12. In the drawing, this thermostat is identified by reference numeral 72. The thermostats 68, 72 and temperature sensors 66, 70 comprise part of control means operatively associated with the air delivery means and the heat generating means of furnace 38 for actuating the air delivery means to deliver air from the upper level interior to the lower level interior through the first and second duct means when a temperature differential of a first predetermined magnitude is sensed by the first and second sensing means. Further, the control means operates to actuate the heat generating means to heat the air delivered by the air delivery means to the lower level interior when a temperature differential of a second predetermined magnitude less than the first predetermined magnitude is sensed by the first and second sensing means.

The other operational components of the control means will now be described as will the operational relationship of the control means to the remainder of the apparatus.

Figure 2:
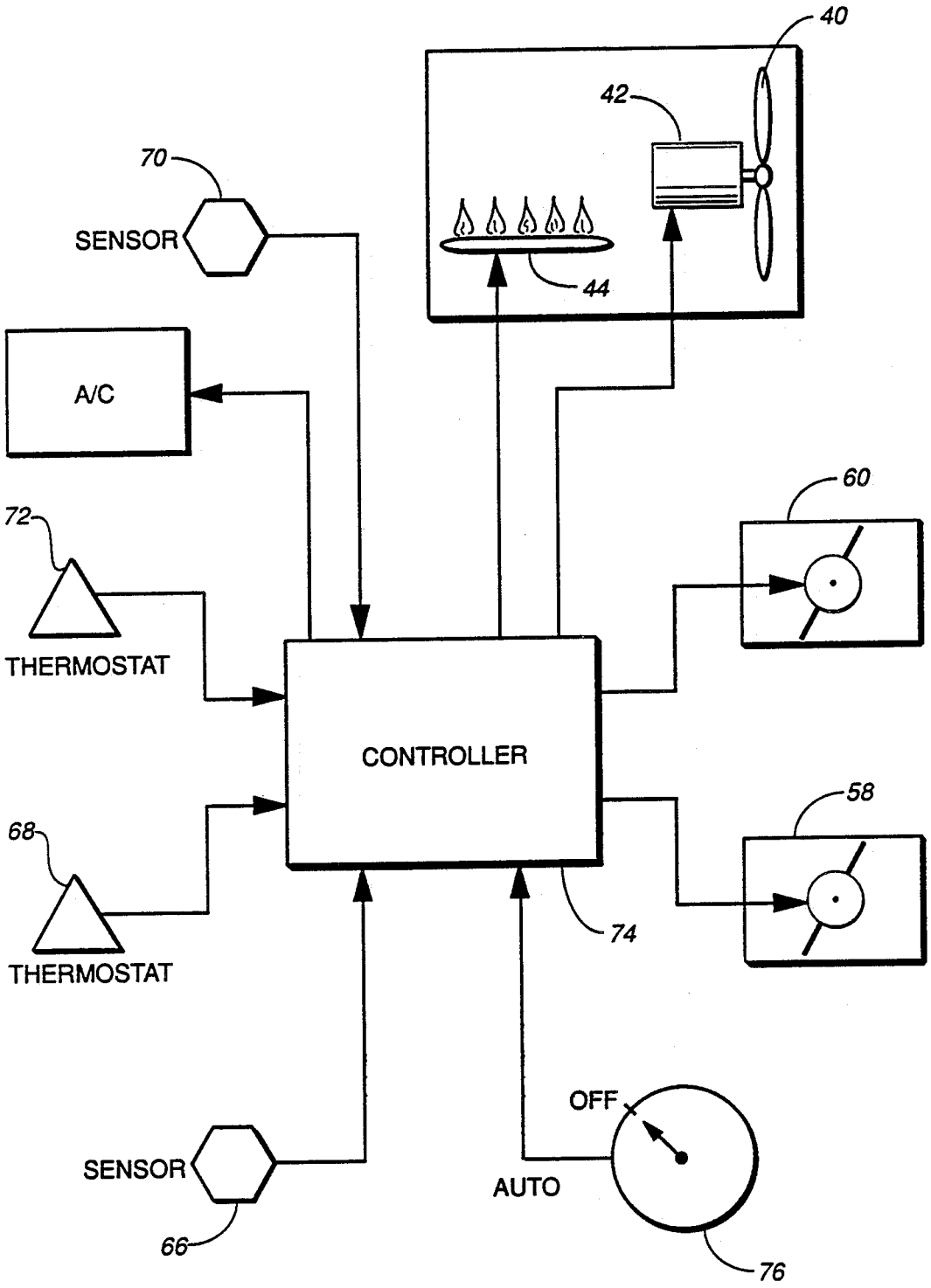
FIG. 2 is a schematic presentation of selected components of the apparatus and illustrating the cooperative relationship existing therebetween.

Located at a suitable location within building 10 is a controller 74. In the arrangement shown in FIG. 1, controller 74 is connected to furnace 38, although it is to be understood that the controller may be placed at any other accessible area. The controller is preferably a microprocessor unit suitably programmed to perform the functions desired. As shown in FIG. 2, the controller 74 is wired to the thermostats 68, 72 and sensors 66, 70 to receive the inputs thereof. Additionally, controller 74 is operatively associated with a two-way control switch 76 which has alternative "auto", "off" modes.

The user operates the system in much the same way he or she would operate two separate heating/cooling systems. The thermostat at each floor should be set to the desired mode (heat or cool) and the desired temperature. For heat stratification control, switch 76 is set to the "auto" position. If the upper and lower level interiors have a differential below a predetermined magnitude (for example 3 degrees Fahrenheit), each thermostat 68, 72 has separate control of the heating system. When either thermostat calls for heat, the damper serving that particular floor is opened or remains open. Also, motor 42 is energized to rotate fan 40 and the heat generating means of furnace 38 is actuated to heat the air delivered by the air delivery means. The other damper will be closed if the thermostat of the interior served thereby is not calling for heat. Thus, heated air will be delivered only to the interior level calling for heat.

Should, however, the temperature of the interior of upper level 12 exceed the temperature of the interior of lower level 14 by a predetermined higher temperature differential (for example, 6 degrees Fahrenheit or more), the controller 74 controls the system in a different manner. More specifically, if thermostat 68 associated with the lower level interior calls for heat, damper 58 serving that floor remains open while the upper level damper 60 is closed. Also, motor 42 is energized to rotate fan 40. This draws the heat from the upper level interior through ducts 62 and 52 and directs it to the lower level interior. This, of course, heats the lower level interior and this operation continues until either thermostat 68 is satisfied or the temperature of the upper level interior drops to within 3 degrees Fahrenheit (or other preselected temperature differential) of the lower level interior temperature.

In the former case, motor 42 will be deactuated, thereby terminating air flow. In the latter situation, the heat generating means of the furnace will be actuated to heat the air delivered by the air delivery means to the lower level interior. When thermostat 68 is satisfied both the heat generating means and the air delivery means are deactuated.

When it is the upper thermostat 72 calling for heat, the heat generating means and the air delivery means will be actuated and the damper 60 opened to provide heat as required.

When control switch 76 is set to the off position, the upper level thermostat 72 can be set at higher temperatures than the lower level thermostat 68.

The present arrangement can be employed in association with an air conditioner, designated as AC in FIG. 2, with each thermostat cooperating with the air conditioner in a conventional manner. That is, when either thermostat calls for cooling, the air delivery means and outdoor condenser unit are energized and the appropriate damper opened. Each level interior is cooled independently, receiving cooled air as needed.

Normally, the user would set both thermostats 68, 72 to operate in the same mode, either heat, cool or off. However, if desired, one interior might be heated and the interior of the other level cooled sequentially, if so desired. In such a case, the heating call would take preference and the interior calling for heating would be satisfied first before cooled air is directed to the other level.

I claim:

1. Apparatus for use in a building having upper and lower levels, each level including a floor, a ceiling, and walls between the floor and ceiling defining an interior, said apparatus adapted to modify the temperatures of said interiors and comprising, in combination:

air delivery means;

heat generating means;

first duct means providing air flow communication between said air delivery means and said upper and lower levels;

second duct means providing air flow communication between said upper level interior and said air delivery means;

first temperature sensing means for sensing the temperature of said lower level interior;

second temperature sensing means for sensing the temperature of said upper level interior; and control means operatively associated with said air delivery means and said heat generating means for actuating said air delivery means to deliver air from said upper level interior to said lower level interior through said first and second duct means when a temperature differential of a first predetermined magnitude is sensed by said first and second sensing means and for actuating said heat generating means to heat the air delivered by said air delivery means to said lower level interior when a temperature differential of a second predetermined magnitude less than said first predetermined magnitude is sensed by said first and second sensing means.

2. The apparatus according to claim 1 wherein said air delivery means and said heat generating means are components of a furnace.

3. The apparatus according to claim 1 wherein said first duct means includes two discrete ducts, one of said ducts having an outlet in communication with said lower level interior and the other of said ducts have an outlet in communication with said upper level interior.

4. The apparatus according to claim 3 additionally comprising damper means operatively associated with said first duct means, said damper means including a damper in the duct having an outlet in communication with said upper level interior and movable between an open position whereat air delivered by said air delivery means enters said upper level interior to a closed position whereat air from said air delivery means is substantially prevented from entering said upper level interior, said control means operable to move said damper to said closed position when a temperature differential of said first predetermined magnitude is sensed by said first and second sensing means.

5. The apparatus according to claim 1 additionally comprising switch means operatively associated with said control means for selectively bypassing said control means.

6. The apparatus according to claim 1 wherein said second duct means has an inlet located at the ceiling of said upper level and wherein said second temperature sensing means comprises a temperature probe located at said second duct means inlet.

7. The apparatus according to claim 1 wherein said control means comprises a differential temperature controller device.

8. A method of modifying the temperatures in upper and lower level interiors of a multi-level building, said method comprising the steps of:

sensing the temperature of said lower level interior;

sensing the temperature of said upper level interior;

initiating air flow through an air flow duct from said upper level interior to said lower level interior when a temperature differential of a first predetermined magnitude is sensed by said first and second sensing means;

maintaining said air flow;

while maintaining said air flow, initiating heating of said flowing air when a temperature differential of a second predetermined magnitude less than said first predetermined magnitude is sensed by said first and second sensing means.

9. The method according to claim 8 including the additional step of terminating the flow of heated air to said lower level interior when the temperature of said lower level interior attains predetermined level.

10. The method according to claim 8 wherein said first predetermined magnitude is in the order of about 6 degrees Fahrenheit.

11. The method according to claim 8 wherein said second predetermined magnitude is in the order of about 3 degrees Fahrenheit.

* * * * *